US005501809A

United States Patent [19]

Schober et al.

[11] Patent Number: 5,501,809

[45] Date of Patent: Mar. 26, 1996

[54] ELECTRORHEOLOGICAL FLUIDS CONTAINING PARTICLES OF A POLAR SOLID MATERIAL AND AN INACTIVE POLYMERIC MATERIAL

[75] Inventors: Barton J. Schober; Carlos A. Piedrahita, both of Mentor; Joseph W. Pialet, Euclid, all of Ohio

[73] Assignee: The Lubrizol Corporation, Wickliffe, Ohio

[21] Appl. No.: 293,536

[22] Filed: Aug. 19, 1994

[51] Int. Cl.[6] ..... C10M 107/36; C10M 101/02; C10M 149/00

[52] U.S. Cl. ..... 252/73; 252/77; 252/572

[58] Field of Search ..... 252/73, 77, 572

[56] References Cited

U.S. PATENT DOCUMENTS

| | | | |
|---|---|---|---|
| 3,047,507 | 7/1962 | Winslow | 252/75 |
| 3,348,958 | 10/1967 | Cockerhann et al. | 106/176 |
| 3,711,433 | 1/1973 | Willey | 260/17 R |
| 3,992,558 | 11/1976 | Smith-Johannsen | 427/213 |
| 4,668,417 | 5/1987 | Goossens | 252/75 |
| 4,781,978 | 11/1988 | Duan | 428/383 |
| 4,992,192 | 2/1991 | Ahmed | 252/73 |
| 5,073,282 | 12/1991 | Ahmed | 252/77 |
| 5,213,895 | 5/1993 | Hirai et al. | 423/403 |
| 5,266,230 | 11/1993 | Tomizawa et al. | 252/73 |
| 5,286,413 | 2/1994 | Hannecart et al. | 252/500 |

FOREIGN PATENT DOCUMENTS

| | | |
|---|---|---|
| 281274 | 7/1988 | European Pat. Off. . |
| 394049 | 10/1990 | European Pat. Off. . |
| 427520 | 5/1991 | European Pat. Off. . |
| 6397694 | 4/1988 | Japan . |
| 646093 | 1/1989 | Japan . |
| 335095 | 2/1991 | Japan . |
| 3119098 | 5/1991 | Japan . |
| 3160094 | 7/1991 | Japan . |
| 3192195 | 8/1991 | Japan . |
| 5239482 | 2/1992 | Japan . |
| 6-220481 | 8/1994 | Japan . |
| 9000583 | 1/1990 | WIPO . |
| 9307243 | 4/1993 | WIPO . |
| 9307244 | 4/1993 | WIPO . |

*Primary Examiner*—Paul Lieberman
*Assistant Examiner*—Gregory R. Delcotto
*Attorney, Agent, or Firm*—David M. Shold; Frederick D. Hunter, Sr.

[57] ABSTRACT

An electrorheological fluid is prepared from a hydrophobic liquid medium and a dispersed particulate phase of (i) a polar solid material which is capable of exhibiting electrorheological activity in the presence of a low molecular weight polar material and (ii) a non-cellulosic polymeric material having a solubility parameter of about 15 to about 50 $(MPa)^{1/2}$ and exhibiting substantially no electrorheological activity in the absence of a low molecular weight polar material. The fluid optionally contains a low molecular weight polar activator. The fluid has good electrorheological performance over a broad temperature range.

29 Claims, No Drawings

ELECTRORHEOLOGICAL FLUIDS CONTAINING PARTICLES OF A POLAR SOLID MATERIAL AND AN INACTIVE POLYMERIC MATERIAL

BACKGROUND OF THE INVENTION

The present invention relates to particles suitable for use in electrorheological fluids and electrorheological fluids containing such particles.

Electrorheological ("ER") fluids are fluids which can rapidly and reversibly vary their apparent viscosity in the presence of an applied electric field. ER fluids are generally dispersions of finely divided solids in hydrophobic, electrically non-conducting oils. They have the ability to change their flow characteristics, even to the point of becoming solid, when subjected to a sufficiently strong electrical field. When the field is removed, the fluids revert to their normal liquid state. ER fluids may be used in applications in which it is desired to control the transmission of forces by low electric power levels, for example, in clutches, hydraulic valves, shock absorbers, vibrators, or systems used for positioning and holding work pieces in position.

The prior art teaches the use of a variety of fine particles, some with surface coatings of various types. For example, PCT Publication WO/93/07244, published Apr. 15, 1993, discloses electrorheological fluid comprising polyaniline. The polymer can be formed in the presence of solid substrates such as silica, mica, talc, glass, alumina, zeolites, cellulose, organic polymers, etc. In these embodiments, the polymerized aniline generally is deposited on the substrate as a coating which may also penetrate into the open pores in the substrate.

Japanese Publication 5,239,482, Feb. 28, 1992, discloses inorganic or organic particles, coated with a polyaniline, and the polyaniline-coated particles dispersed as a dispersed phase. The effect is that an electro-viscous fluid having large electro-viscous effects is obtained.

One of the goals in development of a practical electrorheological fluid is to provide a fluid which exhibits a combination of good yield stress and shear stress under field (i.e., high ER activity) and low current density. Moreover, the fluid should have a fast response time, that is, be able to respond to a field within a matter of milliseconds. Finally, the fluid should exhibit this desirable combination over a useful, broad temperature range. The materials of the present invention exhibit such a useful combination of properties.

SUMMARY OF THE INVENTION

The present invention provides an electrorheological fluid of a particulate phase and a continuous phase, comprising:

(a) a hydrophobic liquid medium; and (b) a dispersed particulate phase comprising (i) a polar solid material which is capable of exhibiting electrorheological activity in the presence of a low molecular weight polar material and which exhibits a room-temperature conductivity of at most about $10^{-4}$ S/cm; and (ii) a non-cellulosic polymeric material which has a solubility parameter of about 15 to about 50 $(MPa)^{1/2}$ and which exhibits substantially no electrorheological activity in the absence of a low molecular weight polar material.

In another embodiment the electrorheological fluid further comprises (c) a low molecular weight polar material.

The present invention further provides a method for reducing the conductivity of an electrorheological fluid of a particulate phase and a continuous phase, which fluid comprises:

(a) a hydrophobic liquid medium; and (b) particles of a polar solid material which is capable of exhibiting electrorheological activity in the presence of a low molecular weight polar material and which exhibits a room-temperature conductivity of at most about $10^{-4}$ S/cm;

said method comprising including in the fluid (c) a non-cellulosic polymeric material which has a solubility parameter of about 15 to about 50 $(MPa)^{1/2}$ and which exhibits substantially no electrorheological activity in the absence of a low molecular weight polar material, in an amount suitable to reduce the conductivity of said fluid.

The invention also provides a method for increasing the apparent viscosity of a fluid of a particulate phase and a continuous phase, said fluid comprising:

(a) a hydrophobic liquid medium;

(b) particles of a polar solid material which is capable of exhibiting electrorheological activity in the presence of a low molecular weight polar material and which exhibits a room-temperature conductivity of at most about $10^{-4}$ S/cm; and (c) a non-cellulosic polymeric material which has a solubility parameter of about 15 to about 50 $(MPa)^{1/2}$ and which exhibits substantially no electrorheological activity in the absence of a low molecular weight polar material;

said method comprising applying an electric field to said fluid.

The invention also provides a clutch, valve, shock absorber, damper, or torque transfer device containing the fluid set forth above.

DETAILED DESCRIPTION OF THE INVENTION

The first component of the present electrorheological fluids is a hydrophobic liquid phase, which is a non-conducting, electrically insulating liquid or liquid mixture. Examples of insulating liquids include silicone oils, transformer oils, mineral oils, vegetable oils, aromatic oils, paraffin hydrocarbons, naphthalene hydrocarbons, olefin hydrocarbons, chlorinated paraffins, synthetic esters, hydrogenated olefin oligomers, hydrocarbon oils generally, and mixtures thereof. The choice of the hydrophobic liquid phase will depend largely on practical considerations including compatibility of the liquid with other components of the system, solubility of certain components therein, and the intended utility of the ER fluid. For example, if the ER fluid is to be in contact with elastomeric materials, the hydrophobic liquid phase should not contain oils or solvents which affect those materials. Similarly, the liquid phase should be selected to have suitable stability over the intended temperature range, which in the case of the present invention will extend to 120° C. or even higher. Furthermore, the fluid should have a suitably low viscosity in the absence of a field that sufficiently large amounts of the dispersed phase can be incorporated into the fluid. Suitable liquids include those which have a viscosity at room temperature of 1 to 300 or 500 centistokes, or preferably 2 to 20 or 50 centistokes. Mixtures of two or more different non-conducting liquids can be used for the liquid phase. Mixtures can be selected to provide the desired density, viscosity, pour point, chemical and thermal stability, component solubility, etc.

Useful liquids generally have as many of the following properties as possible: (a) high boiling point and low freezing point; (b) low viscosity so that the ER fluid has a low no-field viscosity and so that greater proportions of the solid dispersed phase can be included in the fluid; (c) high electrical resistance and high dielectric breakdown potential, so that the fluid will draw little current and can be used over a wide range of applied electric field strengths; and (d) chemical and thermal stability, to prevent degradation on storage and service.

Alkylene oxide polymers and interpolymers and derivatives thereof where the terminal hydroxyl groups have been modified by esterification, etherification, etc., constitute a class of insulating liquids. These are exemplified by polyoxyalkylene polymers prepared by polymerization of ethylene oxide or propylene oxide, the alkyl and aryl ethers of these polyoxyalkylene polymers (e.g., methyl-poly isopropylene glycol ether having an average molecular weight of 1000, diphenyl ether of poly-ethylene glycol having a molecular weight of 500–1000, diethyl ether of polypropylene glycol having a molecular weight of 1000–1500); and mono- and polycarboxylic esters thereof, for example, the acetic acid esters, mixed $C_3$–$C_8$ fatty acid esters and $C_{13}$ Oxo acid diester of tetraethylene glycol.

Another suitable class of insulating liquids comprises esters of dicarboxylic acids (e.g., phthalic acid, succinic acid, alkyl succinic acids and alkenyl succinic acids, maleic acid, azelaic acid, suberic acid, sebasic acid, fumaric acid, adipic acid, linoleic acid dimer, malonic acid, alkylmalonic acids, alkenyl malonic acids) with a variety of alcohols and polyols (e.g., butyl alcohol, hexyl alcohol, dodecyl alcohol, 2-ethylhexyl alcohol, ethylene glycol, diethylene glycol, monoether, propylene glycol). Specific examples of these esters include dibutyl adipate, di(2-ethylhexyl) sebacate, di-n-hexyl fumarate, dioctyl sebacate, diisooctyl azelate, diisodecyl azelate, dioctyl phthalate, didecyl phthalate, dieicosyl sebacate, the 2-ethylhexyl diester of linoleic acid dimer, and the complex ester formed by reacting one mole of sebacic acid with two moles of tetraethylene glycol and two moles of 2-ethylhexanoic acid. By way of example, one of the suitable esters is di-isodecyl azelate, available under the name Emery™ 2960.

Esters useful as insulating liquids also include those made from $C_5$ to $C_{18}$ monocarboxylic acids and alcohols, polyols, and polyol ethers such as isodecyl alcohol, neopentyl glycol, trimethylolpropane, pentaerythritol, dipentaerythritol and tripentaerythritol.

Polyalpha olefins and hydrogenated polyalpha olefins (referred to in the art as PAOs) are useful in the ER fluids of the invention. PAOs are derived from alpha olefins containing from 2 to about 24 or more carbon atoms such as ethylene, propylene, 1-butene, isobutene, 1-decene, etc. Specific examples include polyisobutylene having a number average molecular weight of 650; a hydrogenated oligomer of 1-decene having a viscosity at 100° C. of 8 cSt; ethylene-propylene copolymers; etc. An example of a commercially available hydrogenated polyalpha olefin is Emery™ 3004.

Silicon-based oils such as the polyalkyl-, polyaryl-, polyalkoxy-, or polyaryloxysiloxane oils and silicate oils comprise a particularly useful class of insulating liquids. These oils include tetraethyl silicate, tetraisopropyl silicate, tetra-(2-ethylhexyl) silicate, tetra-(4-methyl-2-ethylhexyl) silicate, tetra-(p-terbutylphenyl) silicate, hexa-(4-methyl-2-pentoxy) disiloxane, poly(methyl) siloxanes, including poly(dimethyl)siloxanes, and poly(methylphenyl) siloxanes. The silicone oils are useful particularly in ER fluids which are to be in contact with elastomers.

Among the suitable vegetable oils for use as the hydrophobic liquid phase are sunflower oils, including high oleic sunflower oil available under the name Trisun™ 80, rapeseed oil, and soybean oil. Examples of other suitable materials for the hydrophobic liquid phase are set forth in detail in PCT publication WO93/14180, published Jul. 22, 1993. The selection of these or other fluids will be apparent to those skilled in the art.

The second component of the present electrorheological fluids is a dispersed particulate phase. This phase itself comprises two subcomponents. The first of these is a polar solid material which is capable of exhibiting electrorheological activity in the presence of a low molecular weight polar material. This category includes both those materials which are believed to require low molecular weight polar material for their ER activity as well as those which exhibit such activity even in the absence of a low molecular weight polar material. Many ER active solids are known, and any of these, as well as their equivalents, are considered to be suitable for use in the ER fluids of the present invention. The preferred core particles are polymeric materials.

One preferred class of ER active solids suitable for use as this portion of the dispersed phase includes carbohydrate based particles and related materials such as starch, flour, monosaccharides, and preferably cellulosic materials. The term "cellulosic materials" includes cellulose as well as derivatives of cellulose such as microcrystalline cellulose. Microcrystalline cellulose is the insoluble residue obtained from the chemical decomposition of natural or regenerated cellulose. Crystallite zones appear in regenerated, mercerized, and alkalized celluloses, differing from those found in native cellulose. By applying a controlled chemical pretreatment to destroy molecular bonds holding these crystallites, followed by mechanical treatment to disperse the crystallites in aqueous phase, smooth colloidal microcrystalline cellulose gels with commercially important functional and rheological properties can be produced. Microcrystalline cellulose can be obtained from FMC Corp. under the name Lattice™ NT-013. Amorphous cellulose is also useful in the present invention; examples of amorphous cellulose particles are CF1, CF11, and CC31, available from Whatman Specialty Products Division of Whatman Paper Limited, and Solka-Floc™, available from James River Corp. Other cellulose derivatives include ethers and esters of cellulose, including methyl cellulose, ethyl cellulose, hydroxyethyl cellulose, hydroxypropyl cellulose, cellulose nitrates, sodium carboxymethyl cellulose, cellulose propionate, cellulose butyrate, cellulose valerate, and cellulose triacetate. Other cellulose derivatives include cellulose phosphates and cellulose reacted with various amine compounds. Other cellulosic materials include chitin, chitosan, chondroiton sulfate, certain natural gums such as xanthan gum, and viscose or cellulose xanthate. Cellulosic materials, and in particular cellulose, are preferred materials for the present invention. A more detailed listing of suitable cellulosics is set forth in PCT publication WO93/14180.

In another embodiment, the ER active solid particles are particles of organic semiconductive polymers, polarizable polymers, or polyelectrolytes, such as oxidized or pyrolyzed polyacrylonitrile, polyacene quinones, polypyrroles, polyphenylenes, polyphenylene oxides, polyphenylene sulfides, polyacetylenes, polyphenothiazines, polyimidazoles, and preferably polyaniline, substituted polyanilines, and aniline copolymers. Compositions of the above and related materials, treated or doped with various additives including acids, bases, metals, halogens, sulfur, sulfur halides, sulfur oxide, and hydrocarbyl halides can also be employed. A more detailed description of certain of these materials can be found in PCT publications WO93/07243 and WO93/07244, both published Apr. 15, 1993. A preferred organic polymeric semiconductor is polyaniline, particularly the polyaniline prepared by polymerizing aniline in the presence of an oxidizing agent (such as a metal or ammonium persulfate) and 0.1 to 1.6 moles of an acid per mole of aniline, to form an acid salt of polyaniline. The polyaniline salt is thereafter treated with a base to remove some or substantially all of the protons derived from the acid. A more complete description of polyaniline and its preferred method of preparation is set forth in PCT publication WO93/07244, published Apr. 15, 1993. The aniline polymer can be the homopolymer or any of a number of copolymers or modified polymers such as a sulfonated aniline/o-toluidine copolymer.

Inorganic materials which can be suitably used as ER active particles include semiconductors (based on silicon, germanium, and so on), chromic oxide, germanium sulfide, ceramics, copper sulfide, carbon particles, silica gel, magnesium silicate, alumina, silica-alumina, pyrogenic silica, zeolites, and the like. These can be in the form of solid particles or, in certain cases, hollow microspheres, the latter being available from, i.a., PQ Corporation of Valley Forge, Pa. Microspheres include hollow ceramic microspheres, 10–100 mm, containing up to 5% crystalline silica (Extendospheres™ SF-14) and silvercoated ceramic microspheres, 10–75 mm (Metalite™ Silver SF-20)

Another class of suitable ER active solid particles is that of polymeric salts, including silicone-based ionomers (e.g. the ionomer from amine functionalized diorganopolysiloxane plus acid), metal thiocyanate complexes with polymers such as polyethylene oxide, and carbon based ionomeric polymers including salts of ethylene/acrylic or methacrylic acid copolymers or phenolformaldehyde polymers. One preferred polymer comprises an alkenyl substituted aromatic comonomer, a maleic acid comonomer or derivative thereof, and optionally additional comonomers, wherein the polymer contains acid functionality which is at least partly in the form of a salt. Preferably in such materials the maleic acid comonomer is a salt of maleic acid in which the maleic acid comonomer is treated with 0.5 to 2 equivalents of base. Preferably this material is a 1:1 molar alternating copolymer of styrene and maleic acid, the maleic acid being partially in the form of the sodium salt. This material is described in more detail in PCT publication WO93/22409, published Nov. 11, 1993.

Another category of material which can exhibit electrorheological activity is the class of ferroelectric materials. These are materials which exhibit the property of ferroelectricity, which may be seen as an electric analogue of ferromagnetism, that is, in which certain crystals may exhibit a spontaneous dipole moment. The most typical of such materials is barium titanate; others include monobasic potassium phosphate and potassium-sodium tartrate ("Rochelle salts"). Ferroelectric materials have been classified as ferroelectric tartrates, di-hydrogen phosphates and arsenates, the "oxygen-octahedra group" which includes tantalates, niobates, tungstates, and perovskites, and the guanidine compounds. Ferroelectrics and ferroelectricity are described in greater detail in "The Encyclopedic Dictionary of Physics," Pergamon Press, 1961, New York, Vol. 3, pages 94–97.

Other materials which can be used as ER active solid particles include fused polycyclic aromatic hydrocarbons, phthalocyanine, flavanthrone, crown ethers and salts thereof, including the products of polymeric or monomeric oxygen- or sulfur-based crown ethers with quaternary amine compounds, lithium hydrazinium sulfate, carbonaceous particles, and ferrites.

Certain of the above-mentioned solid particles are customarily available in a form in which a certain amount of water or other low molecular weight polar material is present, which is discussed in greater detail below. This is particularly true for polar organic particles such as cellulose or ionic polymers. These liquid polar materials need not necessarily be removed from the particles, but they are not necessarily required for the functioning of the present invention.

Certain of the above-mentioned solid particles exhibit a measure of conductivity or semiconductivity. While a degree of conductivity is often associated with the presence of electrorheological activity, the two phenomena are not coextensive. In particular, materials with unusually high conductivity are not preferred for use as particles, because ER fluids prepared therefrom may consume an unacceptable amount of current in order to maintain an electrical field and ER activity. Accordingly, the solid particles should have a conductivity at room temperature of at most $10^{-4}$ S/cm ($10^{-4}$ $\Omega^{-1}cm^{-1}$), preferably at most $10^{-5}$ S/cm, and more preferably at most $10^{-7}$ S/cm. This conductivity is measured as described in detail in ASTM D-4496-85, a standard for measuring dc resistance or conductance of moderately conductive materials, that is those having a volume resistivity between 1 and $10^{7}$ Ω-cm (or a conductivity between 1 and $10^{-7}$ S/cm). ASTM D-4496 further refers to ASTM D-257 for specific details of electrode systems, test specimens, and measurement techniques.

The particles used as this portion of the ER fluids of the present invention can be in the form of powders, fibers, spheres, rods, core-shell structures, etc. The size of the particles of the present invention is not particularly critical, but generally particles having a number average size of 0.25 to 100 μm, and preferably 1 to 20 μm, are suitable. The maximum size of the particles would depend in part on the dimensions of the electrorheological device in which they are intended to be used, i.e., the largest particles should normally be no larger than the gap between the electrode elements in the ER device. Since the final particles of this invention consist of the primary particle plus a second, polymeric, material which may be present as a coating, the size of the first (core) particle should be correspondingly somewhat smaller than the desired size of the final particle in such cases.

The second subcomponent of the dispersed particulate phase is a non-cellulosic polymeric material which has a Hildebrand solubility parameter of about 15 to about 50 $(MPa)^{1/2}$ and which exhibits substantially no ER activity in the absence of a low molecular weight polar material.

This second subcomponent is, first, a polymeric material. This means that it will be composed of at least several monomer units and will generally have a molecular weight (number average) of at least 1000, preferably at least 2000 or 5000, and in some embodiments 300,000 or even up to 1,000,000 or more. This second component, while a polymer, is a non-cellulosic polymer. That is to say, it is not a material included within the list of cellulosic materials set forth above.

The second particle component, moreover, has a Hildebrand solubility parameter of 15 to 50 $(MPa)^{1/2}$, preferably 20 to 35 $(MPa)^{1/2}$ and more preferably 21.5 to 30 $(MPa)^{1/2}$. This feature is believed to be important to provide for compatibility between this second component and the first, ER-active component, as most such first components can be estimated to have a solubility parameter approximately within this range. Cellulose, for example, has a solubility parameter of about 32.

The solubility parameter referred to herein is the Hildebrand solubility parameter. This parameter is described in detail in *Polymer Handbook,* third edition, ed. J. Brandrup and E. J. Immergut, John Wiley & Sons, New York, 1989, in the chapter "Solubility Parameter Values," E. A. Grulke, pages VII/519 et seq. A list of Hildebrand solubility parameters for certain polymers is found on page VII/544 et seq. of the same reference. Briefly, the solubility parameter $\delta_i$ is defined for solvents as $$\delta_i=(\Delta E^v_i/V_i)^{1/2}$$

where $\Delta E^v_i$ is the energy of vaporization of species i and $V_i$ is the molar volume of species i. While the parameter is most clearly defined for nonpolar solvents, it has been extended to polar solvents and polymeric materials by indirect procedures, as described in the *Polymer Handbook,* page VII/522. A listing of Hildebrand solubility parameters of many commercial polymers is found in Table 3.4, page VII/544, of that reference. The Hildebrand solubility parameter of materials not listed can be estimated by comparison with polymers which are listed or by the experimental methods outlined in that reference, e.g., by solvency testing (screening) or by measuring swelling values of crosslinked samples. Further information about and values for solubility parameters can be found in the *Handbook of Solubility Parameters and Other Cohesion Parameters,* CRC Press, Inc., Boca Raton, A. Barton, 1983. Further experimental details on the estimation of polymer solubility can be found in ASTM D-3132-84.

The non-cellulosic polymeric material which comprises the second portion of the particle phase is, moreover, a material which exhibits substantially no electrorheological activity in the absence of a low molecular weight polar material. That is, the second component will not itself be an intrinsically ER-active material such as certain organic semiconductors. Rather, this material, when formulated into a standard composition for testing for ER activity, will be substantially inactive.

A standard formulation and test for ER activity is described in PCT publication WO93/22409, published Nov. 11, 1993. The material to be tested is supplied as a powder, preferably having a particle size such that it will pass through a 710 μm mesh screen. The particles are thoroughly dried, for instance by heating for several hours in a vacuum oven at 150° C. The dried particles are compounded into a fluid for electrorheological testing by combining on a ball mill 25 g of the particles with 96.35 g of a 10 cSt silicone base fluid and 3.75 g of a functionalized silicone dispersant (EXP 69™) for 24 hours. No water or other low molecular weight polar material is added. The fluid can be tested in an oscillating duct flow device. This device pumps the fluid back and forth through parallel plate electrodes, with a mechanical amplitude of flow of ±1 mm and an electrode gap of 1 mm. A useful mechanical frequency for evaluation is 16–17 Hz. (These conditions provide a maximum shear during the cycle of approximately 20,000 $sec^{-1}$.) The electrorheological activity can be evaluated by comparing the properties of the fluid at 20° C. under a 6 kV/mm field with the properties in the absence of applied field. It is to be understood that the field strength, concentrations of materials, or mechanical design of the test device can be modified as necessary to suit the particular fluid, as will be apparent to the person skilled in the art. The substantial absence of electrorheological activity can be concluded when the shear stress in the presence of the field is substantially identical to that in the absence of field. "Substantially identical" can be interpreted to mean an increase in the shear stress of less than 20%.

Another feature of certain of the preferred non-cellulosic polymeric materials, which may in some cases be related to the lack of electrorheological activity, is a low electrical conductivity. The non-cellulosic polymeric materials are generally non-conductors or insulators rather than semiconductive polymers, and are not the same as the polar solid material of the first subcomponent. The conductivity of suitable polymers is typically less than $10^{-7}$ siemens/cm (i.e. $\Omega$-cm)$^{-1}$, and preferably less than $10^{-8}$ or $10^{-9}$ S/cm. This is in contrast with conductive polymers such as polythiophene, polypyrrole, polyacetylene or polyaniline, which (in their fully doped conditions) typically exhibit conductivity of $10^{-6}$ S/cm, $10^{-4}$ S/cm, or more. It is to be understood that certain polymers and other materials are substantially non-conductive and lacking in ER activity in their pure form. However, some such materials, when treated with a dopant such as an acid, a source of metal ions, or a halogen, exhibit increased conductivity and a measure of electrorheological activity. Thus certain polymers may be useful as the second sub-component, or coating component, when prepared in their substantially pure form, but may be useful as the first sub-component, or core component, when doped or otherwise treated to impart conductivity thereto.

Typical non-cellulosic polymeric materials useful as this component of the present invention include polymers containing monomeric units of N-vinylpyrrolidone, alkyloxazolines, acrylonitrile, N-vinylacetamide, ethylene oxide, ethylenimine, vinyl methyl ether, vinyl alcohol, 4-vinylpyridine, 2-vinylpyridine, N-vinylimidazole, caprolactone, caprolactam, or acrylamides. Of course, copolymers of one or more of these monomeric units are also included, as will be apparent to the person skilled in the art of polymer synthesis and chemistry. It is also to be understood that some of these materials are polymers formed by ring-opening reactions of the monomer units, so that the monomers will not appear in their original form in the polymer. Likewise is it is well known that certain of these polymers are to be prepared indirectly by post-treatment of a polymer. For example, it is well known than polymers of vinyl alcohol are prepared by hydrolysis of polyvinyl esters, since vinyl alcohol is unstable.

Among the suitable polymers, poly(N-vinylpyrrolidone), polyethyloxazoline, polyacrylamides, and polycaprolactone are preferred. It is also noted that many of the suitable non-cellulosic polymeric materials are nitrogen-containing polymers and, in particular, amide-containing polymers, which are also preferred.

The present invention is not limited to any particular structural relationship between the polar solid material (i) and the non-cellulosic polymeric material (ii). Thus these two materials can be present in the electrorheological fluid as substantially separate particles, or they can be present as mixed particles containing both components. In the latter case, the mixed particles can contain the two components combined in any manner, but preferably the non-cellulosic material will be at least in part coated on the particles of the polar solid electrorheologically active material. This coating can be accomplished by conventional means, such as by application of a solution of the coating polymer onto preexisting particles, followed by drying. Alternatively, the non-cellulosic polymeric material can be polymerized in the presence of particles of the polar, electrorheologically active material. In this case the reaction conditions are believed to affect the extent to which the newly prepared polymer is formed as a coating on the particles, rather than as separate particles. It is believed that polymerization of comparatively dilute solutions of monomer may favor formation of a coating layer. Moreover, the interaction of polymerization initiators with preexisting particles can lead to chain growth from the surface of the particles, including grafting of the coating polymer to the core particle. It is believed that coating of the non-cellulosic polymer onto the ER active particle is preferred, because such coating is expected to reduce the bulk conductivity of the ER fluid, particularly when the coating material is a non-conductor, as described above. When this is the case, it is preferred that the amount of the coating polymer be sufficient to cover a substantial portion of the surface area of the core particles.

It is further preferred that the electrorheological fluids of the present invention further include a low molecular weight polar material, sometimes referred to as an activator. This low molecular weight polar material is a material other than any of the aforementioned components. These materials are referred to as polar compounds in that they generally have a dielectric constant of greater than 5. They are also commonly relatively low molecular weight materials, having a molecular weight of 450 or less, preferably 225 or less.

Certain ER-active particles, such as cellulose or polymeric salts, commonly have a certain amount of water associated with them. This water can be considered to be one type of polar activating material. The amount of water present in the compositions of the present invention can be 0.1 to 30 percent by weight, based on the solid particles, although extensive drying can result in lower water contents, and indeed water as such is not believed to be required for the functioning of this invention. The polar activating material can be introduced to the ER fluid as a component of the solid particles (such as absorbed water), or it can be separately added to the fluid upon mixing of the components. Whether the polar activating material remains dispersed through the bulk of the ER fluid or whether it associates with one or both of the components of the particle phase is not precisely known in every case, and such knowledge is not essential to the functioning of the present invention. It has been observed that, when the low molecular weight activating material is employed, the presence of the non-cellulosic polymeric material can, in favorable cases, lead to electrorheological activity which is less dependent on temperature than is the case in the absence of the non-cellulosic polymer.

Suitable polar activating materials can include water, amines, amides, nitriles, alcohols, polyhydroxy compounds, low molecular weight esters, and ketones. Suitable polyhydroxy include ethylene glycol, glycerol, 1,2-propanediol, 1,3-propanediol, 1,4-butanediol, 1,5-pentanediol, 2,5-hexanediol, 2-ethoxyethanol, 2-(2-ethoxyethoxy)ethanol, 2-(2-butoxyethoxy)ethanol, 2-(2-methoxyethoxy)ethanol, 2-methoxyethanol, and 2-(2-hexyloxyethoxy)ethanol. Suitable amines include ethanolamine and ethylenediamine. Other suitable materials are carboxylic acids such as formic acid and trichloroacetic acid. Also included are such aprotic polar materials as dimethylformamide, dimethylsulfoxide, propionitrile, nitroethane, ethylene carbonate, propylene carbonate, pentanedione, furfuraldehyde, sulfolane, diethyl phthalate, and the like. Low molecular weight esters include materials such as ethyl acetate; these materials are distinguished from other esters, which are less polar materials having a dielectric constant less than 5 and with molecular weights commonly greater than 225, preferably greater than 450, which can be used as the inert medium.

While the polar material is believed to be normally physically adsorbed or absorbed by the solid particle phase, it is also possible to chemically react at least a portion of the polar material with one or more of the particle components. This can be done, for example, by condensation of alcohol or amine functionality of certain polar materials with an acid or anhydride functionality on the electrorheologically active particle or its precursor. Such treatment would normally be effected before any coating material is applied to the particles.

The relative amounts of the components of the present invention are not strictly limited to any numerical quantities but include all amounts for which the composition exhibits electrorheological properties.

The ER fluid may also contain other typical additives which are commonly employed in such materials, including antioxidants, antiwear agents, and dispersants. Surfactants or dispersants are often desirable to aid in the dispersion of the particles and to minimize or prevent their settling during periods of non-use. Such dispersants are known and can be designed to complement the properties of the hydrophobic fluid. For example, functionalized silicone dispersants or surfactants may be the most suitable for use in a silicone fluid, while hydroxyl-containing hydrocarbon-based dispersants or surfactants may be the most suitable for use in a hydrocarbon fluid. Functionalized silicone dispersants are described in detail in PCT publication WO93/14180, published Jul. 22, 1993, and include e.g. hydroxypropyl silicones, aminopropyl silicones, mercaptopropyl silicones, and silicone quaternary acetates. Other dispersants include acidic dispersants, ethoxylated nonylphenol, sorbitan monooleate, glycerol monooleate, basic dispersants, sorbitan sesquioleate, ethoxylated coco amide, oleic acid, t-dodecyl mercaptan, modified polyester dispersants, ester, amide, or mixed ester-amide dispersants based on polyisobutenyl succinic anhydride, dispersants based on polyisobutyl phenol, ABA type block copolymer nonionic dispersants, acrylic graft copolymers, octylphenoxypolyethoxyethanol, nonylphenoxypolyethoxyethanol, alkyl aryl ethers, alkyl aryl polyethers, amine polyglycol condensates, modified polyethoxy adducts, modified terminated alkyl aryl ethers, modified polyethoxylated straight chain alcohols, terminated ethoxylates of linear primary alcohols, high molecular weight tertiary amines such as 1-hydroxyethyl-2-alkyl imidazolines, oxazolines, perfluoralkyl sulfonates, sorbitan fatty acid esters, polyethylene glycol esters, aliphatic and aromatic phosphate esters, alkyl and aryl sulfonic acids and salts, tertiary amines, and hydrocarbyl-substituted aromatic hydroxy compounds, such as $C_{24-28}$ alkyl phenols, polyisobutenyl ($M_n$ 940) substituted phenols, propylene tetramer substituted phenols, polypropylene ($M_n$ 500) substituted phenols, and formaldehyde-coupled substituted phenols.

The amounts of materials within the present electrorheological fluids are not critical and can be adjusted by the person skilled in the art to obtain the optimum electrorheological properties. The amount of the hydrophobic base fluid is normally the amount required to make up 100% of the composition after the other ingredients are accounted for. Often the amount of the base fluid is 10–94.9 percent of the total composition, preferably 36–89 percent, and most preferably 56–79 percent. These amounts are normally percent by weight, but if an unusually dense dispersed solid phase is used, it may be more appropriate to determine these amounts as percent by volume.

Similarly, the amount of the total particulate phase in the ER fluid should be sufficient to provide a useful electrorheological effect at reasonable applied electric fields. However, the amount of particles should not be so high as to make the fluid too viscous for handling in the absence of an applied field. These limits will vary with the application at hand: an electrorheologically active grease, for instance, would desirably have a higher viscosity in the absence of an electric field than would a fluid designed for use in e.g. a valve or clutch. Furthermore, the amount of particles in the fluid may be limited by the degree of electrical conductivity which can be tolerated by a particular device, since the particles normally impart at least a slight degree of conductivity to the total composition. For most practical applications the particles will comprise 1 to 80 percent by weight of the ER fluid, preferably 5 to 60 percent by weight, more preferably 10 to 50 percent by weight, and most preferably 15 to 35 percent by weight. Of course if the nonconductive hydrophobic fluid is a particularly dense material such as carbon tetrachloride or certain chlorofluorocarbons, these weight percentages could be adjusted to take into account the density. Determination of such an adjustment would be within the abilities of one skilled in the art.

Generally the components within the particle phase, that is (i), the polar ER-active solid material, and (ii), the non-cellulosic polymeric material, are present in relative amounts of 200:1 to 1:1 by weight. Preferably the relative amounts are 100:1 to 8:1, and more preferably 50:1 to 10:1 or 50:1 to 20:1. More generally, the amount of the non-cellulosic polymeric material (ii) should be an amount which leads to acceptable ER performance, and preferably improved performance compared with the same material in the absence of this component. In particular, it is especially desirable to use an amount sufficient to lead to increased ER activity and or reduced power consumption (power density) of the fluid. ER activity can be measured simply in terms of increase in shear strength, as defined by the test reported above. A more complete evaluation can be made by considering the steady-state Winslow number, Wn, measured at a constant field after the fluid has reached a (constant) maximum strength:

$$Wn = \frac{(YS)^2}{(PD)(\eta_o)}$$

YS=Yield stress (Pa) under field

PD=Power density (w/m$^3$) at steady state =Current density x Field strength $\eta_o$=Viscosity with no field applied (PaS)

Alternatively, for some applications the "millisecond Winslow number," Wn' is more useful:

$$Wn' = \frac{(\Delta SS)^2}{(PD)(\eta_0)}$$

where PD and $\eta_0$ are defined as above and ΔSS is the shear stress increase at 5 ms when field is applied. This measurement is made using a 5 Hz oscillation (about 6000 s$^{-1}$); the shear stress 5 milliseconds after application of a field (normally 6 kV/mm) is measured, and the shear stress in the absence of field is subtracted therefrom. A higher value for Wn or Wn' indicates better ER performance overall.

The amounts of the low molecular weight polar material activating material is preferably 0.5 to 10 percent by weight, based on the entire fluid composition, preferably 2 to 5 weight percent, based on the fluid.

The amount of the optional surfactant or dispersant component in the present invention is an amount sufficient to improve the dispersive stability of the composition. Normally the effective amount will be 0.1 to 20 percent by weight of the fluid, preferably 0.4 to 10 percent by weight of the fluid, and most preferably 1 to 5 percent by weight of the fluid.

The ER fluids of the present invention find use in clutches, valves, dampers, torque transfer devices, positioning equipment, and the like, where it is desirable to vary the apparent viscosity of the fluid in response to an external signal. Such devices can be used, for example, to provide an automotive shock absorber which can be rapidly adjusted to meet the road conditions encountered during driving.

As used herein, the term "hydrocarbyl substituent" or "hydrocarbyl group" is used in its ordinary sense, which is well-known to those skilled in the art. Specifically, it refers to a group having a carbon atom directly attached to the remainder of the molecule and having predominantly hydrocarbon character. Such groups include hydrocarbon groups, substituted hydrocarbon groups, and hetero groups, that is, groups which, while primarily hydrocarbon in character, contain atoms other than carbon present in a chain or ring otherwise composed of carbon atoms.

EXAMPLES

Example 1

Preparation of poly(N-vinylpyrrolidone) polymerized on cellulose. The following materials are reacted in a 4-necked, 2 L round bottom flask equipped with a heating mantle, a ground glass thermowell, a mechanical stirring rod, a water condenser, and a gas inlet adapter for nitrogen inlet, as follows:

| Materials | Amount |
|---|---|
| Cellulose | 202 g |
| 1-Vinyl-2-pyrrolidinone | 20 g |
| Cyclohexane | 1160 ml |
| Perkadox ™ 16N (bis(4-t-butylcyclohexyl)peroxydicarbonate) | 1.04 g |
| Hexanes | 800 ml |

The cellulose and 960 mL of cyclohexane are charged to the flask and the contents stirred at medium speed with nitrogen purge at 15.6 standard L/hr (0.55 scfh) for 15 minutes. The 1-vinyl-2-pyrrolidinone monomer is added and the mixture is heated to 60° C. After the mixture has reached 60° C., the gas inlet adapter is replaced with an addition adapter. The nitrogen inlet tube is attached to the side-arm of the adapter and nitrogen addition is continued.

The Perkadox™ 16N initiator is dissolved in 200 mL of cyclohexane. The initiator solution is charged to the reaction mixture using a peristaltic pump at a uniform rate of 2 mL/min over 100 minutes. After the addition is complete, the addition adapter is replaced with the gas inlet adapter and the temperature is increased to 80° C. and maintained at that temperature for 6 hours. Thereafter the flask is allowed to cool to room temperature.

The product is isolated by filtration through paper by pulling vacuum with a water aspirator. The isolated solids are flushed with 800 mL of hexanes. The solids are transferred into a tared jar and dried in a vacuum oven for 24 hours at 120° C. under dynamic vacuum.

Example 2

Coating of polyethyloxazoline (PEOX) or poly(N-vinylpyrrolidone) (PVP) on cellulose. PEOX or PVP, as indicated, obtained commercially, is coated onto cellulose by the following methods:

a. Rotary evaporation. 16 g of a methanol solution containing 25% PEOX, number average molecular weight about 50,000, is added to a round bottom flask along with 100 g cellulose and 200 g methanol. The solvent is removed by rotary evaporation at approximately 40° C. at 1.3–6.6 kPa (10–50 torr). The resulting solid is dried under vacuum (130 Pa, 1 torr) at room temperature for 12–24 hours, sieved through a 710 μm screen, and dried as in Example 1.

b. Precipitation. 2.4 g of PVP, number average molecular weight about 40,000, is dissolved in 1000 mL water with stirring. To the solution is added 97.6 g cellulose. Acetone, 3000 mL, is added dropwise over 3 hours. The mixture is let stir overnight, and the resulting solids are isolated by filtration. The solids are dried as in Example 1.

c. Spray Drying. A slurry is prepared containing 86 g of a 10% aqueous solution of the above-described PEOX, 790 g water, and 236 g cellulose. The slurry is spray dried using a Buchi™ 190 Mini Spray Dryer, which includes a cyclone collector. The spray dryer is set to inlet temperature of 150° C., outlet temperature of 85° C., aspirator control setting of 18 (arbitrary units), heater control setting of 9–10 (arbitrary units), and pump flow control of approximately 10–12 mL/min. The sample is collected from the cyclone and dried as in Example 1.

Example 3

Physical admixture. Into a ball mill jar containing 7 ceramic media are placed 29.26 g dried cellulose, 0.76 g dried poly(N-vinylpyrrolidone), 3.0 g EXP 69198 surfactant, 3.0 g ethylene glycol, and 64 g 5 cSt silicone oil. The jar is turned on a roller for 24 hours and the resulting composition evaluated for electrorheological activity.

Example 4

Preparation of electrorheological fluids. Into a ball mill jar containing 7 ceramic media are added 30.0 g of the dried solid from Example 1, 3.0 g EXP 69™ surfactant, 3.0 g ethylene glycol, and 64 g 5 cSt silicone oil. The jar is turned on a roller for 24 hours and the resulting composition evaluated for electrorheological activity.

Example 5

Example 4 is substantially repeated using the dried solid from each of parts a, b, and c of Example 2.

Example 6

Example 5 is substantially repeated, using the solid materials of each of parts a, b, and c of Example 2, except in place of the silicone oil is used 65 g Emery™ 2911 ester. In place of the 3 g EXP 69™ surfactant is used 2.0 g $C_{24-28}$ alkyl substituted phenol.

Example 7

Example 4 is substantially repeated except that the 3 g surfactant is eliminated and the amount of silicone oil is increased to 67 g.

Example 8

Cellulose (CC31™) is coated with PEOX using the spray drier apparatus and conditions of Example 2(c). The PEOX concentrations are varied so that the PEOX is applied in the following amounts (based on the total of PEOX+cellulose):

| | % (theory) | % (analysis) | Mw of PEOX |
|---|---|---|---|
| a | 1.4 | 2.7 | 5,000 |
| b | 3.5 | 3.6 | 5,000 |
| c | 4.9 | 8.6 | 5,000 |
| d | 1.4 | 1.1 | 5,000 |
| e | 1.4 | 1.1 | 50,000 |
| f | 4.9 | 7.6 | 50,000 |
| g | 3.5 | 4.4 | 50,000 |
| h | 3.3 | — | 500,000 |
| i | 35 | — | 50,000 |

The foregoing compositions are each compounded into an electrorheological fluid as in Example 6 and the resulting fluids tested for electrorheological activity.

Example 9

Example 2(c) is repeated except that the cellulose is replaced by a comparable amount of each of the following materials, in turn:

(a) sodium carboxymethylcellulose;

(b) polyaniline, prepared according to the process disclosed in PCT publication WO93/07244. More particularly, 415 g concentrated hydrochloric acid is in 3 L distilled water is combined in a 12 L round bottom flask with 465 g aniline, which is added dropwise and the mixture is cooled to 5° C. and a solution of ammonium persulfate, 1140 g in 3.5 L of distilled water, is added dropwise over 8 hours. The reaction mixture is stirred several hours, then filtered and the solids are collected.

The solids are washed for 24 hours with 6 L of water, and the mixture is again filtered and the solids are collected. The solids are washed with 330 mL concentrated ammonium hydroxide and 6 L distilled water for 24 hours. The solids are collected and washed with 330 mL concentrated ammonium hydroxide and 6 L water for 48 hours. The solids are collected and washed with 6 L distilled water for 24 hours. The mixture is thereafter filtered and the solid flushed with 4 L of distilled water.

The recovered solid is predried for 18 hours at 20° C., sieved through a 710 μm screen, and dried at 150° C. under vacuum for 17 hours;

(c) silicon (elemental silicon particles with a native silicon oxide surface layer);

(d) silica gel;

(e) barium titanate;

(f) styrene-maleic anhydride 1:1 alternating copolymer, sodium salt, as described in PCT publication WO93/22409.

The foregoing compositions are each compounded into an electrorheological fluid as in Example 6 and the resulting fluids tested for electrorheological activity.

Example 10

Example 2(a) is substantially repeated except that the PEOX is replaced by a comparable amount of each of the following materials, in turn:

(a) polyvinyl alcohol, using water rather than methanol;

(b) polyacrylamide, using water rather than methanol;

(c) polyacrylonitrile, using ethylene carbonate rather than methanol.

The foregoing compositions are each compounded into an electrorheological fluid as in Example 4 and the resulting fluids tested for electrorheological activity.

Example 11

Example 4 is substantially repeated except that in place of the ethylene glycol there is used the following materials in the indicated amounts:

(a) water, 0.5%;

(b) propylene glycol, 10%

(c) 2-(2-butoxyethyoxy)ethanol, 5%

(d) glycerol, 2%

Each of the foregoing compositions are tested for electrorheological activity.

Example 12

Example 4 is substantially repeated, using the amounts of materials (percentages based on total fluid composition) as indicated:

| | Particles | Ethylene glycol | EXP 69 ™ | Silicone Oil |
|---|---|---|---|---|
| a | 70 | 10 | 3 | 17 |
| b | 40 | 5 | 5 | 50 |
| c | 35 | 5 | 5 | 55 |
| d | 15 | 1.5 | 1 | 82.5 |
| e | 5 | 1 | 0.5 | 93.5 |
| f | 1 | 0.1 | 0 | 98.9 |

Each of the documents referred to above is incorporated herein by reference. Except in the Examples, or where otherwise explicitly indicated, all numerical quantities in this description specifying amounts of materials, reaction conditions, molecular weights, number of carbon atoms, and the like, are to be understood as modified by the word "about." Unless otherwise indicated, each chemical or composition referred to herein should be interpreted as being a commercial grade material which may contain the isomers, by-products, derivatives, and other such materials which are normally understood to be present in the commercial grade. However, the amount of each chemical component is presented exclusive of any solvent or diluent oil which may be customarily present in the commercial material, unless otherwise indicated. As used herein, the expression "consisting essentially of" permits the inclusion of substances which do not materially affect the basic and novel characteristics of the composition under consideration.

What is claimed is:

1. An electrorheological fluid of a particulate phase and a continuous phase, comprising:

(a) a hydrophobic liquid medium; and (b) a dispersed particulate phase comprising (i) a polar solid material consisting of a cellulosic material which is capable of exhibiting electrorheological activity in the presence of a low molecular weight polar material and which exhibits a room-temperature conductivity of less than about $10^{-4}$ S/cm; and (ii) a non-cellulosic polymeric material consisting of polymers derived from polymerization of monomeric units of alkyloxazolines which has a solubility parameter of about 15 to about 50 $(MPa)^{1/2}$ and which exhibits substantially no electrorheological activity in the absence of a low molecular weight polar material.

2. The electrorheological fluid of claim 1 further comprising (c) a low molecular weight polar material.

3. The electrorheological fluid of claim 2 wherein the cellulosic material is cellulose.

4. The electrorheological fluid of claim 2 wherein the non-cellulosic polymeric material is polyethyloxazoline.

5. The electrorheological fluid of claim 2 wherein the non-cellulosic polymeric material has a solubility parameter of about 20 to about 35 $(MPa)^{1/2}$.

6. The electrorheological fluid of claim 5 wherein the non-cellulosic polymeric material has a solubility parameter of about 21.5 to about 30 $(Mpa)^{1/2}$.

7. The electrorheological fluid of claim 2 wherein the low molecular weight polar material is selected from the group consisting of water, amines, amides, nitriles, alcohols, polyhydroxy compounds, low molecular weight esters, and ketones.

8. The electrorheological fluid of claim 2 wherein the low molecular weight polar material is a polyol.

9. The electrorheological fluid of claim 8 wherein the polyol is ethylene glycol.

10. The electrorheological fluid of claim 2 wherein the hydrophobic liquid medium is silicone oil.

11. The electrorheological fluid of claim 2 wherein the hydrophobic liquid medium is a hydrocarbon oil.

12. The electrorheological fluid of claim 2 wherein the hydrophobic liquid medium is an ester.

13. The electrorheological fluid of claim 2 wherein components (i) and (ii) are present in relative ratios of about 200:1 to about 1:1 by weight.

14. The electrorheological fluid of claim 13 wherein components (i) and (ii) are present in relative ratios of about 100:1 to about 8:1 by weight.

15. The electrorheological fluid of claim 14 wherein components (i) and (ii) are present in relative ratios of about 50:1 to about 10:1 by weight.

16. The electrorheological fluid of claim 2 wherein the polar, electrorheologically active solid material and the non-cellulosic polymeric material are present as substantially separate particles.

17. The electrorheological fluid of claim 2 wherein the polar, electrorheologically active solid material and the non-cellulosic polymeric material are present as mixed particles containing both components.

18. The electrorheological fluid of claim 17 wherein the non-cellulosic polymeric material is at least in part coated on particles of the polar, electrorheologically active solid material.

19. The electrorheological fluid of claim 17 wherein the non-cellulosic polymeric material has been polymerized in the presence of particles of the polar, electrorheologically active solid material.

20. The electrorheological fluid of claim 2 wherein the non-cellulosic polymeric material is grafted onto particles of the polar electrorheologically active solid material.

21. The electrorheological fluid of claim 2 wherein the amount of the low molecular weight polar material is about 0.5 to about 10 percent by weight of the fluid.

22. The electrorheological fluid of claim 21 wherein the amount of the low molecular weight polar material is about 2 to about 5 percent by weight of the fluid.

23. The electrorheological fluid of claim 2 wherein components (i) and (ii) together comprise about 1 to about 80 percent by weight of the fluid.

24. The electrorheological fluid of claim 2 wherein components (i) and (ii) together comprise about 5 to about 40 percent by weight of the fluid.

25. The electrorheological fluid of claim 2 wherein components (i) and (ii) together comprise about 15 to about 35 percent by weight of the fluid.

26. The electrorheological fluid of claim 2 further comprising a surfactant.

27. A method for reducing the conductivity of an electrorheological fluid of a particulate phase and a continuous phase, which fluid comprises:

(a) a hydrophobic liquid medium; and (b) particles of a polar solid material consisting of a cellulosic material which is capable of exhibiting electrorheological activity in the presence of a low molecular weight polar material and which exhibits a room-temperature conductivity of less than $10^{-4}$ S/cm;

said method comprising including in the fluid (c) a non-cellulosic polymeric material consisting of polymers derived from polymerization of monomeric units of alkyloxazolines which has a solubility parameter of about 15 to about 50 $(MPa)^{1/2}$ and which exhibits substantially no electrorheological activity in the absence of a low molecular weight polar material, in an amount suitable to reduce the conductivity of said fluid.

28. The method of claim 27 wherein the non-cellulosic polymeric material is coated onto the particles of the polar, electrorheologically active solid material.

29. The method of claim 27 wherein the electrorheological fluid further comprises (d) a low molecular weight polar material.

* * * * *